United States Patent [19]

Etnestad et al.

[11] 4,257,336

[45] Mar. 24, 1981

[54] ARRANGEMENT IN INCINERATOR

[75] Inventors: Hermann Etnestad, Gjovik; Sverre Laugerud, Harestua, both of Norway

[73] Assignee: O. Mustad & Son A/S, Gjovik, Norway

[21] Appl. No.: 12,749

[22] Filed: Feb. 16, 1979

[30] Foreign Application Priority Data

Feb. 17, 1978 [NO] Norway ..... 780550

[51] Int. Cl.[3] ..... F23G 5/00; F23G 7/00

[52] U.S. Cl. ..... 110/245; 432/58; 34/57 A

[58] Field of Search ..... 110/245, 268, 328, 327; 34/57 A, 57 C; 432/58; 122/40; 211/151

[56] References Cited

U.S. PATENT DOCUMENTS

| | | | |
|---|---|---|---|
| 3,026,626 | 4/1962 | Smith | 34/57 A |
| 3,256,612 | 6/1966 | Dollinger | 34/57 A |
| 4,067,118 | 1/1978 | Morin | 432/58 |
| 4,131,072 | 12/1978 | Lingl, Jr. et al. | 110/327 |

*Primary Examiner*—Henry C. Yuen

*Attorney, Agent, or Firm*—Finnegan, Henderson, Farabow, Garrett & Dunner

[57] ABSTRACT

A fluidized bed incinerator is split along horizontal planes into three parts, viz. an upper part, an annular section comprising the region in which the fluidized bed and any pipe coils for cooling the bed are situated, and an underlying windbox. The annular middle section can be readily replaced simply by moving the upper part and the windbox apart, horizontally withdrawing the annular section and inserting a new section. During operation of the incinerator the three parts are clamped together.

7 Claims, 3 Drawing Figures

ARRANGEMENT IN INCINERATOR

BACKGROUND OF THE INVENTION

Field of the Art

The present invention relates to an arrangement in incinerators in which a fuel is burned in a fluidized bed of refractor particles, especially incinerators in which pipe coils for the circulation of a coolant are provided in the section of the incinerator in which the fluidized bed is located, said coils extending out through the shell of the incinerator.

Incinerators operating with a fluidized bed have many advantages, one being that they can burn a number of different fuels, including fuels of relatively low calorific value. When the incinerator is operating on high-grade fuels, e.g. oil, it may be desirable or necessary to cool the fluidized bed of refractory particles such as sand, and this cooling can be effected by means of a coolant circulating through pipe coils arranged in the fluidized bed. The ends of the pipe coils extend out through the shell of the incinerator to permit circulation of the coolant. The heat of the heated coolant may of course be utilized in various ways outside the incinerator. By changing the speed of the coolant and/or the temperature of the supplied fluidizing gas it is possible to achieve extensive accommodation to the calorific value of the fuel for maintenance of the desired heat balance in the fluidized bed.

When certain low-grade fuels are used, no cooling can be allowed. However, to stop the circulation of coolant in the pipe coils completely is not tolerable, since they may then burn out. In theory, it is feasible to remove the pipe coils when the incinerator is to be fired with low-grade fuels, but this usually involves an extensive and complicated modification of the incinerator.

SUMMARY OF THE INVENTION

The object of the present invention is to provide an incinerator in which the replacement of the pipe coils can be effected rapidly and simply, so that a change between the use of high-grade and low-grade fuels can be easily effected.

According to the invention the section of the incinerator in which the fluidized bed and the pipe coils, if any, are located, is designed as a separate ring which is clamped between the upper part of the incinerator above the ring and the windbox below the ring. The ring may preferably have flanges engaging corresponding flanges at the lower edge of the upper part of the incinerator and at the upper edge of the windbox respectively.

In this manner the entire annular section of the incinerator shell containing the pipe coils can be readily replaced simply by moving the windbox and the upper part of the incinerator away from each other, then withdrawing the annular separate section at right angles to the vertical longitudinal axis of the incinerator and inserting a new section. Finally, the windbox and the upper part of the incinerator are clamped together so as to clamp the intermediate annular section between them. The new section to be inserted may be a section having no pipe coils if the incinerator is to burn low-grade fuels not permitting a cooling of the fluidized bed, but it is of course also possible to insert a section of the same type as the one removed, e.g. if the pipe coils are burnt out and must be replaced. In such a case it is considerably quicker and easier to replace the entire annular section, whereupon the task of replacing the pipe coil in the removed section can be carried out outside the incinerator and without interfering with its operation.

According to a further feature of the invention the upper part of the incinerator is preferably supported by posts which are permanently connected to the incinerator, while the windbox is suspended from the posts by means of power transmission means which allow raising and lowering of the windbox on the posts. Screw jacks can preferably be used as power transmission means.

The replaceable annular section preferably carries lateral wheels which engage supporting rails when the windbox is lowered, and which allow the annular section to be wheeled on the rails to a position where the ring can be handled by a hoisting device. Thereby it is only necessary to lower the windbox a short distance (10–15 cm) in order to release the ring section. During the first part of the downward movement of the windbox the replaceable ring will accompany the windbox, but then the wheels engage the rails, and when the windbox is lowered further, the ring may be wheeled freely on the rails independently of both the windbox and the upper part of the incinerator.

DESCRIPTION OF THE PREFERRED EMBODIMENT

Figure 1:
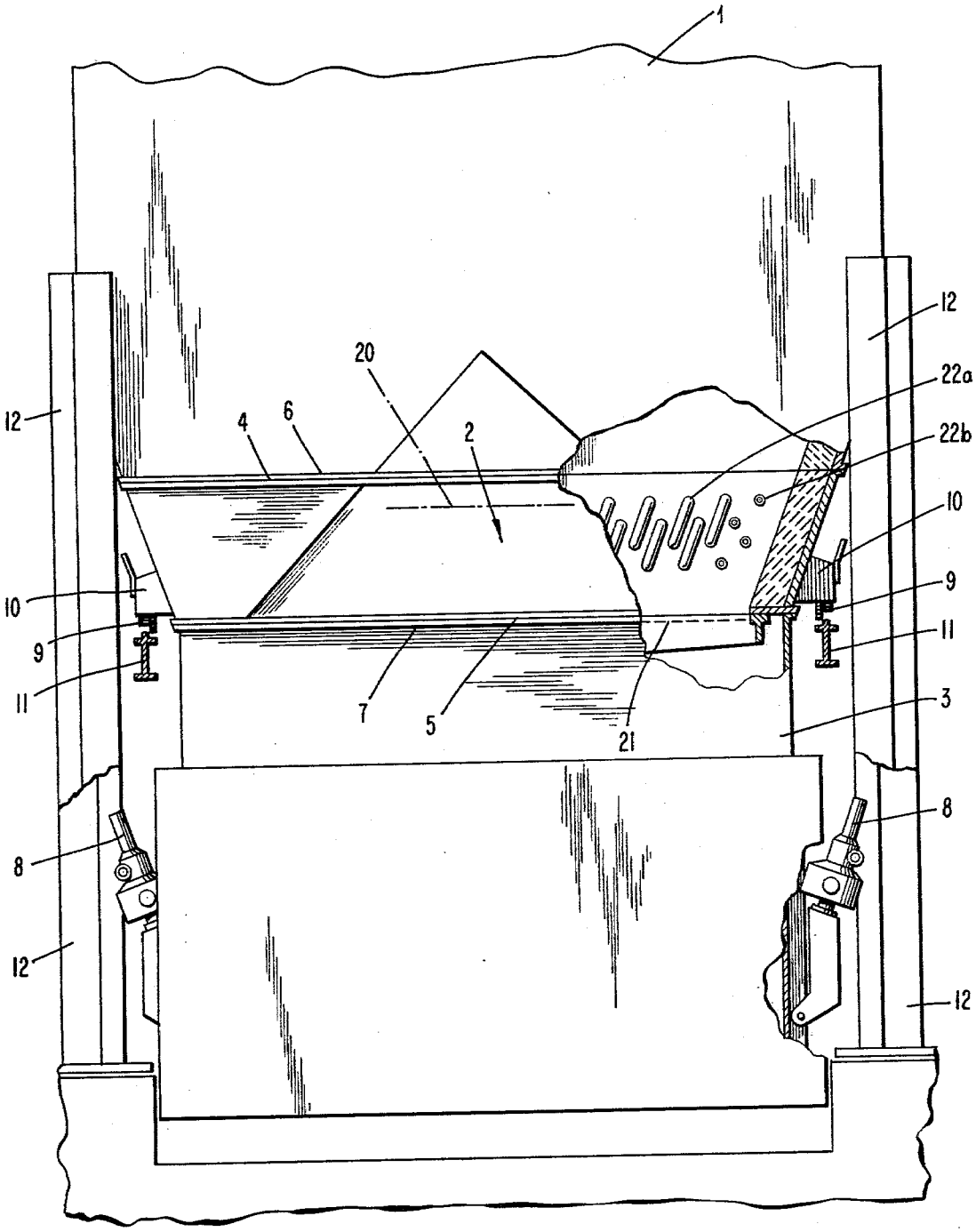
FIG. 1 is a general schematic diagram of a fluidized bed incinerator constructed in accordance with the present invention, shown in partial cut-away form to reveal details of its construction.
Figure 2:
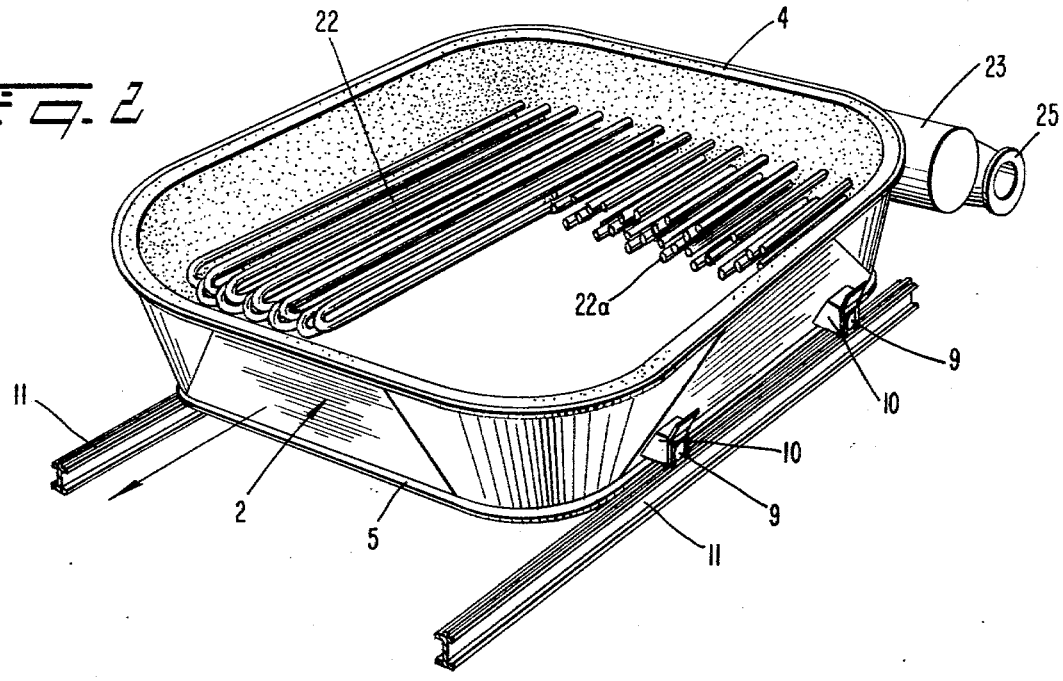
FIG. 2 is a perspective view of the preferred embodiment of the movable annular shell section.

The invention will now be further explained reference being had to the drawings.

The incinerator shown in the Figures consists of an upper part 1, an intermediate slab or ring-shaped section 2 and an underlying windbox 3. The ring or annular section 2 is provided with flanges 4, 5 which engage corresponding flanges 6 and 7 at the lower edge of the upper part of the incinerator and at the upper edge of the windbox 3, respectively. Between the flanges 4, 6 and 5, 7 resilient gaskets can be arranged, which are compressed when the ring 2 is clamped between the upper part 1 and the windbox 3.

In the plan shown in the Figures the upper part 1 of the incinerator is carried by four posts 12 which are permanently connected to the upper part 1. The windbox 3 is suspended on the posts 12 by means of screw jacks 8 or similar power transmission means which allow the windbox 3 to be pulled up towards the portion 1 for clamping the ring 2 between the part 1 and the windbox 3. The screw jacks 8 also permit lowering of the windbox 3. During lowering the ring 2 will accompany the windbox 3 during the first part of its downward movement, but after a short movement of e.g. 7 cm, wheels 9 which are rotatably journalled in brackets 10 will engage rails 11 which extend horizontally on both sides of the incinerator to a region outside the incinerator. Upon further lowering of the windbox 3 the ring 2 will be retained by the rails 11 and thus be free from both the upper part 1 of the incinerator and the windbox 3. The ring 2 can thereupon be wheeled on the rails 11 out to a position outside the incinerator where it can be engaged by a hoisting device, e.g. a crane, tackle or the like, for replacement by another annular section to be inserted in the incinerator. The new section will then be wheeled into place on the rails 11, whereupon the windbox 3 can again be raised, clamping the ring 2 between the flanges 6 and 7.

The upper level 20 of the static bed shown in FIG. 1. Before the ring 2 is removed, the bed of refractory particles such as sand should preferably be emptied. This is in fact essential if the bottom of the incinerator, i.e. the gas constriction plate 21 through which the fluidizing air is passed is positioned at the upper end of the windbox 3, as preferred, and is carried by the windbox instead of forming a part of the section 2 of the incinerator to be replaced.

Figure 3:
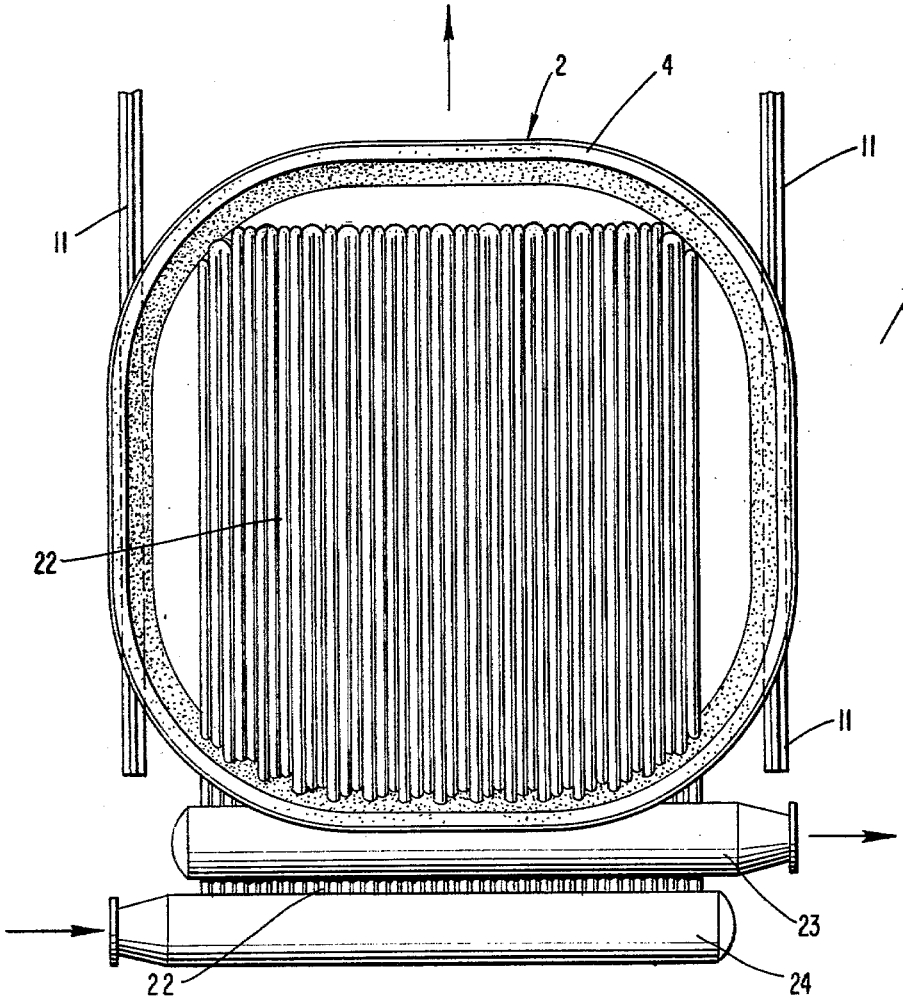
FIG. 3 is a plan view of the preferred embodiment of the movable annular shell section.

Cooling coils 22 provided in the ring section 2 are shown in FIGS. 1 and 3, with the ends of the pipe coils being suitably passed out through the incinerator shell at its rear to, for example, cooling liquid manifolds 23, 24. In FIG. 1, cooling coils 22 are shown in end view 22*a* and in section 22*b*. These pipe coils 22 are of no significance as regards replaceability, except that connections to inlet and outlet pipes for coolant must of course be uncoupled before the section 2 can be removed. The term "pipe coils" also includes pipe loops or windings which are not necessarily coiled.

What we claim is:

1. A fluidized bed incinerator apparatus, comprising:

(a) a windbox having an upper edge defining an opening;

(b) an upper shell section situated above and spaced from the windbox, the upper shell section having a lower edge defining an opening; and (c) an annular shell section wherein the fluidized bed is located, the annular shell section having a lower edge for abutting the upper edge of the windbox and having an upper edge for abutting the lower edge of the upper shell section, the annular shell section being movable from a position of abutment between the windbox and the upper shell section openings to a position laterally spaced from said openings.

2. A fluidized bed incinerator apparatus as claimed in claim 1, including first and second flanges protruding from the upper edge of the windbox and the lower edge of the upper shell section, respectively, and further including third and fourth flanges protruding from the lower and upper edges of the annular shell section, respectively, for engaging the first and second flanges, respectively, when the annular shell section is in a position of abutment between the windbox and upper shell section openings.

3. A fluidized bed incinerator apparatus as claimed in claims 1 or 7, further comprising clamping means for securing abutment of the upper and lower edges of the annular shell section with the lower edge of the upper shell section and the upper edge of the windbox, respectively.

4. A fluidized bed incinerator apparatus as claimed in claim 3, further comprising support posts secured to the upper shell section for fixedly supporting the upper shell section, wherein the clamping means comprises power transmission means secured to the support posts and the windbox for raising the windbox and the annular shell section to bring the annular shell section into abutment between the windbox and upper shell section openings, and for lowering the windbox and the annular shell section prior to moving the annular shell section to a position laterally spaced from said openings.

5. A fluidized bed incinerator apparatus as claimed in claim 4, wherein the power transmission means comprises at least one screw jack.

6. A fluidized bed incinerator apparatus as claimed in claim 4, further comprising support rails situated beneath the annular shell section and extending laterally from the windbox and upper shell section openings, and including support wheels secured to the annular shell section for engaging the support rails when the annular shell section and windbox are lowered by the power transmission means, the windbox being lowered further to free the annular shell section, thereby permitting lateral movement of the annular shell section to a position laterally spaced from said openings.

7. A fluidized bed incinerator apparatus as claimed in claims 1 or 2, further comprising cooling means situated in the portion of the annular shell section wherein the fluidized bed is located, the cooling means extending exteriorly of the annular shell section, for circulating a coolant through the fluidized bed to control its temperature.

* * * * *

UNITED STATES PATENT AND TRADEMARK OFFICE

CERTIFICATE OF CORRECTION

PATENT NO. : 4,257,336

DATED : March 24, 1981

INVENTOR(S) : Hermann Etnestad and Sverre Laugerud

It is certified that error appears in the above-identified patent and that said Letters Patent are hereby corrected as shown below:

Claim 3, line 2, change "7" to --2--.

Signed and Sealed this

*Second* Day of *June 1981*

[SEAL]

*Attest:*

RENE D. TEGTMEYER

*Attesting Officer*

*Acting Commissioner of Patents and Trademarks*